US005886570A

United States Patent [19]

Brokaw

[11] Patent Number: 5,886,570

[45] Date of Patent: Mar. 23, 1999

[54] INVERTER CIRCUIT BIASED TO LIMIT THE MAXIMUM DRIVE CURRENT TO A FOLLOWING STAGE AND METHOD

[76] Inventor: A. Paul Brokaw, 81 Macon Rd., Burlington, Mass. 01803

[21] Appl. No.: 956,136

[22] Filed: Oct. 22, 1997

[51] Int. Cl.[6] ..... G05F 1/10; G05F 3/02

[52] U.S. Cl. ..... 327/540; 327/563; 327/483; 327/538

[58] Field of Search ..... 327/538, 540, 327/541, 543, 546, 560, 561, 562, 563, 575, 483, 491, 312, 313, 323, 332

[56] References Cited

U.S. PATENT DOCUMENTS

| | | | |
|---|---|---|---|
| 4,695,807 | 9/1987 | Annacker et al. | 330/310 |
| 4,763,018 | 8/1988 | Moon | 327/538 |
| 4,833,344 | 5/1989 | Moon et al. | 327/540 |
| 4,924,113 | 5/1990 | Schade, Jr. | 327/540 |
| 5,422,593 | 6/1995 | Fujihira | 327/561 |
| 5,436,588 | 7/1995 | Ghaffaripour | 327/538 |
| 5,532,471 | 7/1996 | Khorramabadi et al. | 250/214 A |
| 5,631,598 | 5/1997 | Miranda et al. | 327/540 |
| 5,757,226 | 5/1998 | Yamada et al. | 327/541 |

OTHER PUBLICATIONS

Paul R. Gray, Robert G. Meyer, *Analysis and Design of Analog Integrated Circuits,* Second Edition, John Wiley & Sons, 1984, pp. 282–283.

*Primary Examiner*—Timothy P. Callahan
*Assistant Examiner*—An T. Luu

[57] ABSTRACT

An inverter circuit, suitably implemented in the feedback loop of a series pass regulator, limits the maximum drive current through an output drive transistor connected to control the regulator's pass transistor. A first current source i1 biases an inverting amplifier that includes a transistor and an output resistor R, which inverts an input signal received from an emitter follower and feeds the inverted signal to an output drive transistor which has its collector connected to the base of the pass transistor. A second current source i2 is connected to allow the inverter's input signal to follow the emitter follower negative. When the follower is cut-off, i2 flows through the output resistor and increases the voltage of the signal fed to the output drive transistor by i2×R. The increased voltage establishes a maximum drive current based on i1, i2 and R, which is independent of the betas of the individual transistors.

27 Claims, 6 Drawing Sheets

INVERTER CIRCUIT BIASED TO LIMIT THE MAXIMUM DRIVE CURRENT TO A FOLLOWING STAGE AND METHOD

BACKGROUND OF THE INVENTION

1. Field of the Invention

This invention relates to the field of current limiting circuits, particularly circuits used to limit the drive current delivered to the control input of a voltage regulator's pass transistor.

2. Description of the Related Art

A conventional series pass voltage regulator is shown in FIG. 1*a*. A supply voltage $V_{in}$ is connected to the emitter 10 of a "pass transistor" 12, typically a pnp bipolar transistor, and an output voltage $V_{out}$ is taken at the transistor's collector 14. The output voltage is regulated by controlling pass transistor 12 via its base terminal 16. Regulation is accomplished with a feedback loop: the output voltage is fed back to the inverting input 18 of an error amplifier 20, typically an operational transconductance amplifier (OTA), usually via a voltage divider 22. A voltage reference $V_{ref}$ is connected to the non-inverting input 24 of the amplifier. The amplifier's output is connected to the control input 26 of an output drive transistor 28, whose current circuit is connected to the pass transistor's control input 16.

In operation, error amplifier 20 produces the output necessary to make the voltage at its inputs 18 and 24 equal. Increasing the drive current to output drive transistor 28 increases its collector current $i_c$, which in turn increases the current flow through pass transistor 12 and raises output voltage $V_{out}$.

A regulator such as that shown in FIG. 1 is commonly fabricated as an integrated circuit (I.C.). A problem arises with such an integrated regulator as a result of the unpredictability of the respective "betas" (β) of the transistors in the regulation loop. The OTA 20 has an output transistor 30 having a beta of β1, output drive transistor 28 has a beta of β2, and the pass transistor has a beta of β3. Manufacturing tolerances make it difficult to attain a particular beta value for a particular transistor; rather, a range of possible beta values is typically all that can be predicted. To insure that the regulator can deliver its rated output voltage and current, the regulation loop is usually designed based on "worst case" beta values, resulting in transistors that are likely to be oversized. If $V_{out}$ drops below its rated value, because the regulator output is short-circuited, for example, the regulator loop will attempt to force $V_{out}$ back up. However, if β1 is not at its "worst case" value, the drive into output drive transistor 28 may be higher than desired. This high drive current can be compounded by a higher-than-expected β2, resulting in a very high $i_c$ at the pass transistor's base 16. A higher-than-expected β3 compounds the problem further, and can result in a current through pass transistor 12 that is high enough to damage transistor 12 and associated components.

A simplified schematic of a "low drop-out" (LDO) series pass regulator, described in U.S. Pat. No. 5,631,598 to Miranda et. al and assigned to the present assignee, is shown in FIG. 1*b*. The signals connected to the inputs 18 and 24 of OTA 20 are reversed, and an inverting stage 50 is interposed between the OTA's output and output drive transistor 28. The phase inversion provided by inverting stage 50 permits the connection of a frequency compensation capacitor $C_c$ between the output of OTA 20 and the $V_{out}$ terminal. This regulator, however, also suffers from the problem discussed above: because the regulator must be designed to accommodate uncertain "worst case" beta values, the potential for overdriving and damaging the pass transistor is unacceptably high.

SUMMARY OF THE INVENTION

An inverter circuit is presented which overcomes the problems described above. The circuit, suitably implemented in the feedback loop of a series pass regulator, limits the maximum drive current through an output drive transistor connected to control a following stage, while also providing a phase inversion. Limiting the drive current serves to protect the device to which the drive transistor is connected, typically the pass transistor of a series pass regulator. The limit is established by appropriately selecting the values of two current sources and a resistor, and is independent of the betas of the transistors in the loop.

In a preferred embodiment, a bipolar transistor is configured as an inverting amplifier: an input resistor is connected to its base, an output resistor is connected between base and collector, and the transistor is biased with a first current source i1. The input to the inverter is produced by an emitter follower or diode, and the inverter's output is fed to the base of an output drive transistor whose collector is connected to the base of a pass transistor. As the input to the inverter increases, the signal to the output drive transistor decreases, as does the current to the pass transistor.

When the input to the inverter decreases, output drive transistor current increases. However, because the follower voltage at the input to the inverter can only fall to about the same level as the inverter's output voltage, the output drive current is limited to a value about equal to i1 (or N×i1 if the inverter and output drive transistors have different emitter areas, with N equal to the ratio between them). This is remedied by adding a second current source i2 to the circuit, connected to allow the inverter input to follow the emitter follower's output negative, so that the base of the output drive transistor can be driven more positive.

Current source i2 serves two beneficial purposes. First, it provides for an increased current in the output drive transistor because, when the emitter follower is cut-off, i2 flows through the output resistor and increases the output drive transistor's base voltage. This enables an output drive current to be obtained that is substantially greater than i1 even without using an emitter area ratio, though both techniques are preferably employed. Secondly, as explained below, the output drive current is related to the increased base voltage obtained with i2. As a result, a hard limit is established for the output drive current with appropriate selection of the circuit's i1, i2 and output resistor values, which is set as necessary to protect the pass transistor and associated components. Variations on the basic inverter circuit include circuitry which establishes a maximum current limit that falls with increasing temperature, and which can accommodate manufacturing variations in the pass transistor's beta.

Further features and advantages of the invention will be apparent to those skilled in the art from the following detailed description, taken together with the accompanying drawings.

DETAILED DESCRIPTION OF THE INVENTION

Figure 1A:
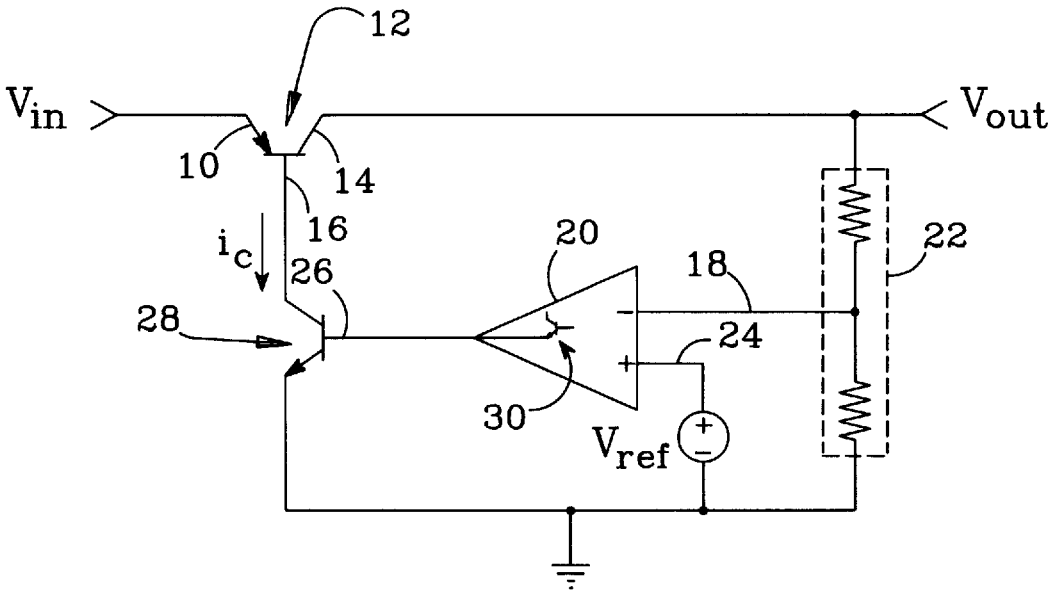
FIG. 1a (Prior Art)
FIG. 1*a* is a schematic diagram of a prior art series pass voltage regulator.
Figure 1B:
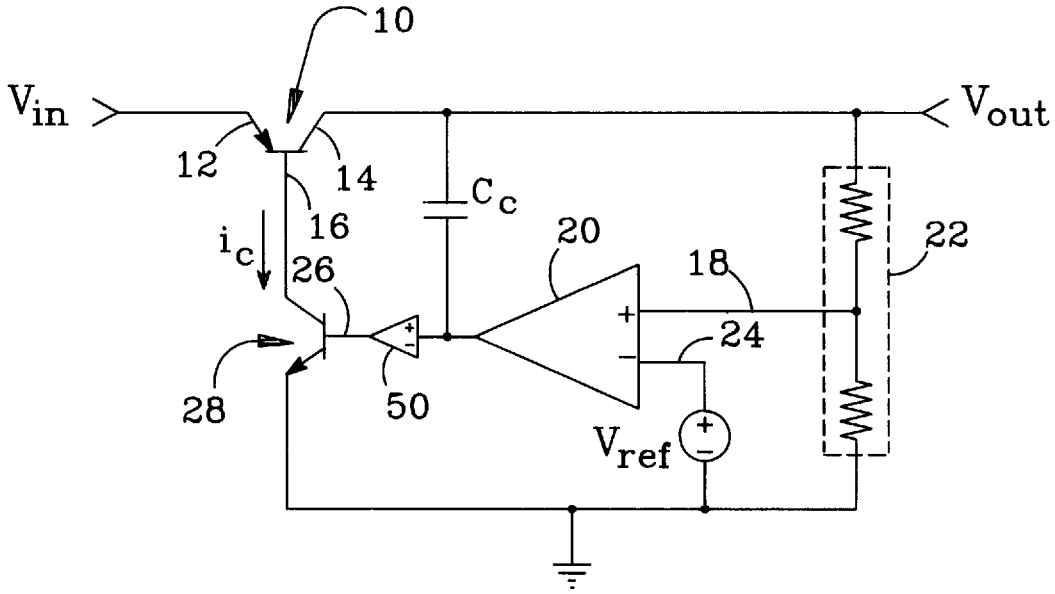
FIG. 1b (Prior Art)
FIG. 1*b* is a schematic diagram of a prior art series pass voltage regulator which includes an inverter stage.
Figure 2A:
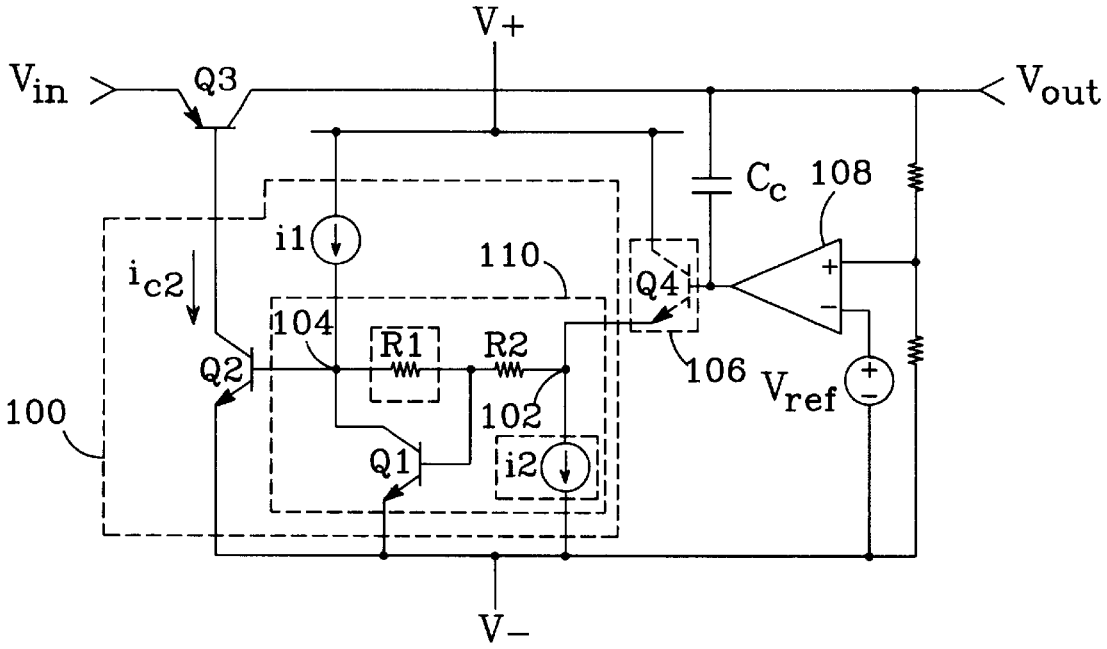
FIG. 2*a* is a schematic diagram of an inverter circuit biased to limit the maximum current through an output drive transistor, as implemented in a series pass voltage regulator.

A schematic diagram of an inverter circuit 100 per the present invention is shown in FIG. 2*a*, implemented in the feedback loop of a series pass voltage regulator. A transistor Q1, shown here as an npn bipolar transistor (though other transistor types are permitted, as discussed below), is configured as an inverting amplifier: an output resistor R1 is connected between Q1's collector and base, an input resistor R2 is connected between its base and the inverter's input node 102, and a current source i1 is powered by a positive supply voltage V+ and supplies current i1 to the node 104 between R1 and the collector. As used herein, reference labels attached to respective current sources also refer to the current generated by that current source; i.e., current source i1 generates a current i1. Q1's emitter is connected to a supply voltage V−, which can include regulator ground. Node 104 serves as the inverting amplifier's output, with the amplifier's gain given by—R1/R2. R1 and R2 are preferably made equal to provide maximum bandwidth, which is desirable in feedback control applications.

Node 104 is connected to the control input of an output drive transistor Q2, shown here as an npn bipolar transistor. The collector of transistor Q2 serves as the output of the inverter circuit, with Q2's collector current herein referred to as "drive current" $i_{c2}$; Q2's collector is connected to the base of pass transistor Q3. The current through pass transistor Q3 is controlled by the drive current $i_{c2}$ through Q2, which is modulated in accordance with the signal applied at Q2's base; i.e., $i_{c2}$ increases as the voltage at Q2's base increases. Pass transistor Q3 is connected to a supply voltage $V_{in}$ at its emitter, and the regulator's output voltage $V_{out}$ appears at its collector.

The inverter's input node 102 is typically driven by a follower device 106, typically either an emitter follower transistor Q4 (shown) or a diode, which may be a component of or separate from an operational amplifier 108, typically an operational transconductance amplifier (OTA). Amplifier 108 is configured as a non-inverting error amplifier and forms part of the regulator's feedback loop, receiving a voltage fed back from the regulator's output $V_{out}$ at a non-inverting input and a reference voltage $V_{ref}$ at an inverting input, and producing an error voltage at an output. Voltage regulation is accomplished as follows: when $V_{out}$ falls below its desired value, error amplifier 108 causes the voltage at the output of follower 106 to also fall. The voltage at inverter amplifier output node 104 increases as inverter input node 102 falls, increasing the current $i_{c2}$ through output drive transistor Q2. An increase in $i_{c2}$ increases the current through the pass transistor Q3, which raises the output voltage $V_{out}$. Conversely, a $V_{out}$ that is too high increases the voltage at input node 102, which decreases $i_{c2}$ and the current through pass transistor Q3, lowering $V_{out}$.

Voltage regulators of the sort shown in FIG. 2*a* are commonly fabricated as an I.C., and are often battery-powered. As a result, small component size and high efficiency are important design considerations. A regulator's pass transistor typically passes a considerable amount of current, and in turn requires a good deal of current at its control input to provide the necessary regulation. In light of these design considerations, it is desirable that the inverter circuit 100 consume as little current as possible to produce the necessary amount of drive current $i_{c2}$. One way in which current source i1 and Q1 can be kept small is by fabricating Q2 with a bigger emitter area than Q1, with a ratio N between Q2's emitter area and Q1's emitter area.

With nothing connected to inverter input node 102 except follower 106 and R2, when the input to follower 106 goes negative enough to cut off Q4, the voltage at the base of Q2 is about the same as that at the base of Q1 (neglecting the small current into the base of Q1). Q2 essentially mirrors the current through Q1, so that the collector current $i_{c2}$ is limited to a maximum of about N×i1.

In order to: 1) get more collector current $i_{c2}$ for a given i1, and to 2) simultaneously provide a simple means of establishing a maximum value for $i_{c2}$, a current source i2 is connected to inverter input node 102. Now, as the output of follower 106 falls, more and more of i2 is drawn through output resistor R1, with all of i2 drawn through R1 when Q4 is cut-off. With i2 flowing through R1, the voltage at the base of Q2 is increased over the voltage at the base of Q1 by an amount ΔV=i2×R1. This increased voltage acts to increase the collector current $i_{c2}$ for a given i1, achieving the first of the goals stated above.

The second stated goal is achieved by noting that the emitters of Q1 and Q2 are connected to the same potential, so that ΔV is given by:

$$\Delta V = V_{be2} - V_{be1} = kT/q \ ln(i_{c2}/(N \times i1)) \quad \text{(Eq. 1)}$$

Solving for the drive collector current $i_{c2}$ through Q2 (and neglecting base currents and the loading of i1 by i2):

$$i_{c2} = N(i1)e^{(i2 \times R1)/(kT/q)} \quad \text{(Eq. 2)}$$

Thus, a maximum drive current $i_{c2}$(max.) through Q2 is established by specifying particular values for i1, i2 and R1. The drive current $i_{c2}$(max.) is independent of the betas of any of the transistors in the feedback loop. Therefore, even when a regulator is designed based on its transistors' "worst case" betas, use of the innovative inverter circuit herein described eliminates the danger of overdriving and damaging regulator components arising from that practice.

In addition to its current-limiting function, the present inverter circuit also provides a phase inversion in a voltage regulator's feedback loop. Thus, a capacitor $C_c$ can be connected between the regulator's output $V_{out}$ and the output of error amplifier 108 to frequency compensate the regulator, as described in the U.S. patent to Miranda et. al cited above.

Though the inverter circuit is implemented in FIG. 2*a* with npn transistors (except for pass transistor Q3), the circuit can also be implemented with pnp transistors—an example of which is discussed below in conjunction with FIG. 4. FET's can also be used to implement a functionally similar inverter circuit, preferably driving a bipolar pass transistor. Note, however, that Equations 1 and 2 above would not be applicable to an all-FET implementation, though similar equations based on the behavior of FETs could still be used to define a maximum limit on drive current.

The invention is described as implemented in the feedback loop of a voltage regulator, but is not limited to this application. The inverter circuit would be useful whenever it is desirable to establish a maximum drive current through an output drive transistor which is connected to control a following stage, such as in an amplifier in which a common emitter stage drives a complementary common emitter stage. Also, because the invention can drive common emitter pass devices, it is useful for amplifiers that need to drive their output voltage close to the supply voltage. Two inverter circuits could be used to create a "rail-to-rail" output stage, one inverter using npn transistors as in FIG. 2*a*, and one using pnp transistors, with the collectors of the respective output drive transistors tied together to make an output driver that could source or sink current.

Figure 2B:
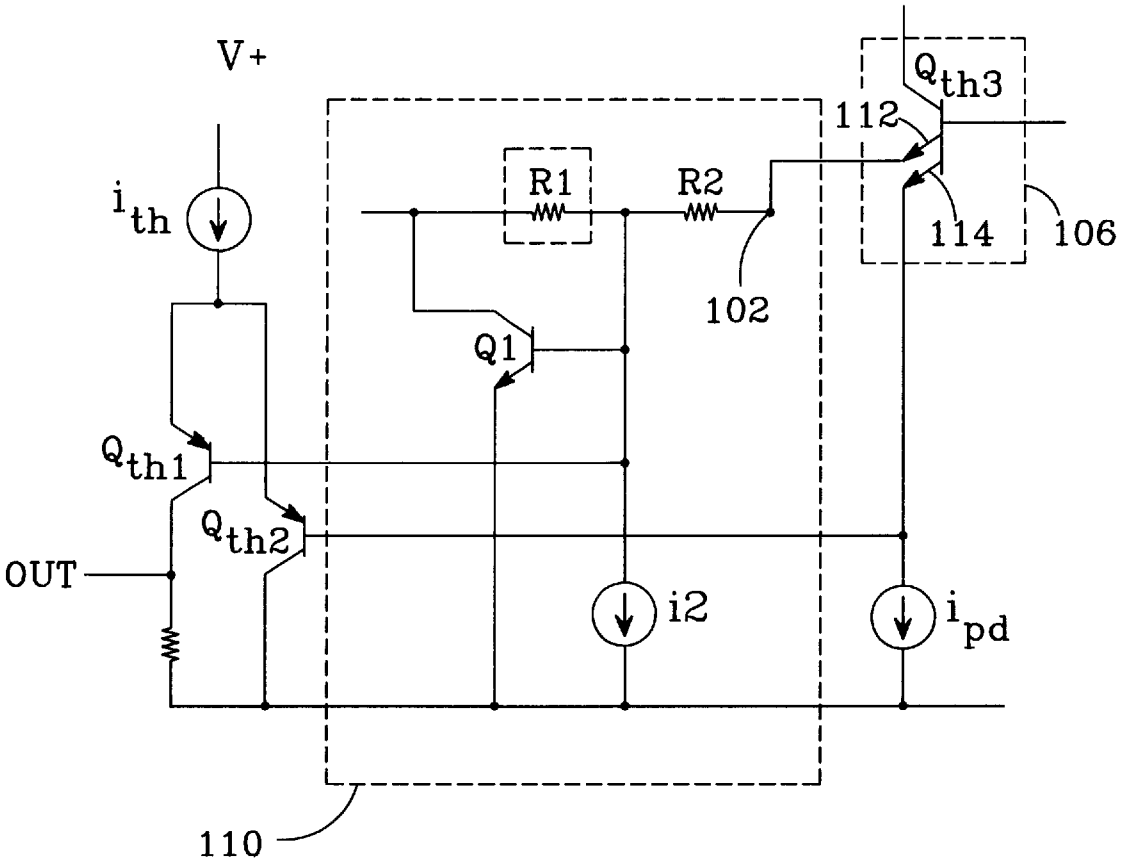
FIG. 2*b* is a schematic diagram illustrating an alternative connection of a current source in the circuit of FIG. 2*a*.

An alternative connection of current source i2 is shown in the schematic diagram of FIG. 2*b*, in which a portion 110 of the schematic of FIG. 2*a* is redrawn. Here, current source i2 is connected directly to the base of Q1. Current i2 continues to affect $i_{c2}$(max.) as defined in Equation 2, but the voltage range over which the follower output affects $i_{c2}$ is shifted. When connected as shown in FIG. 2*b*, the follower is cut-off (and $i_{c2}$(max.) is reached) when the voltage at node 102 falls below that at the base of Q1. When configured as in FIG. 2*a*, $i_{c2}$(max.) is reached when the voltage at node 102 falls below the voltage at the base of Q1 minus (i2×R2). These two configurations of i2 offer some design flexibility over the value of the voltage at the emitter of Q4 when $i_{c2}$(max.) is reached.

An advantage of connecting i2 directly to the base of Q1 is shown in FIG. 2*b*: that of generating a signal which indicates when $i_{c2}$ has reached its maximum value. A threshold detector is created by arranging two transistors $Q_{th1}$ and $Q_{th2}$ into a differential pair biased with a current source $i_{th}$. An output OUT is taken from the collector of $Q_{th1}$; a signal appears at OUT when the voltages at the bases of $Q_{th1}$ and $Q_{th2}$ are unequal. A dual-emitter transistor $Q_{th3}$ is used as the follower device 106, with one emitter 112 connected to inverter input node 102. The base of $Q_{th1}$ is connected to the base of Q1, and the base of $Q_{th2}$ is connected to $Q_{th3}$'s other emitter 114. The voltage at each of $Q_{th3}$'s emitters will be about equal, tracking $Q_{th3}$'s base voltage, until $i_{c2}$(max.) is reached. As noted above, with i2 connected as shown in FIG. 2*b*, the voltage at the base of Q1 and at input node 102 are about equal when $i_{c2}$(max.) is reached. If $Q_{th3}$'s base continues to go negative, emitter 112 will remain at Q1's base voltage. Emitter 114, however, not connected to node 102, will continue to fall with $Q_{th3}$'s base, as long as a small pull-down current source $i_{pd}$ is connected to it. A differential voltage is thus developed across $Q_{th1}$ and $Q_{th2}$ when the regulator calls for a drive current in excess of $i_{c2}$(max.), and a signal indicating this condition appears at the OUT terminal.

Figure 2C:
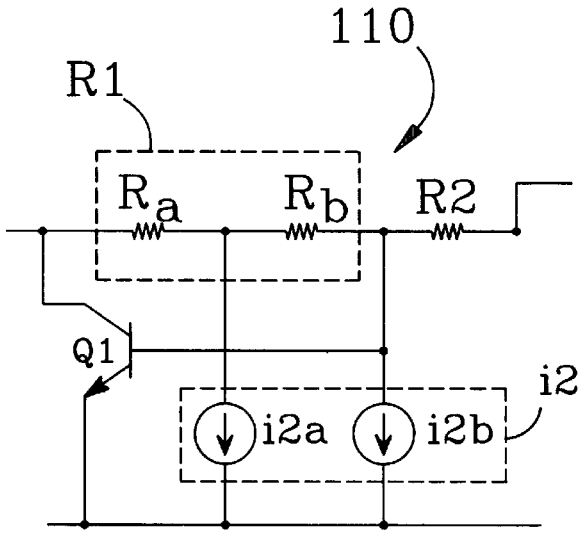
FIG. 2*c* is a schematic diagram illustrating an alternative configuration of a current source in the circuit of FIG. 2*a*.

Another approach to the implementation of current source i2 is shown in FIG. 2*c*. Here, output resistor R1 is split into two resistors $R_a$ and $R_b$ and i2 is split into two current sources i2*a* and i2*b*. $R_a$, $R_b$, i2*a* and i2*b* are arranged to produce a ΔV at node 104 which provides the desired $i_{c2}$(max.); ΔV is now given by:

$$\Delta V=(R_b\times i2a)+(R_a+R_b)\times i2b$$

This type of arrangement, illustrated as a composite of two current sources but amenable to further division, permits i2 to be a composite of several different currents, each of which can have a different behavior with respect to temperature, transistor beta, or some other parameter which one might choose to set $i_{c2}$(max.).

Alternatively, i2*a* and i2*b* might be currents that happen to be available, but which need to be properly proportioned to produce the desired value of i2. $R_a$ and $R_b$ are chosen as necessary to produce the desired scaling.

Figure 3A:
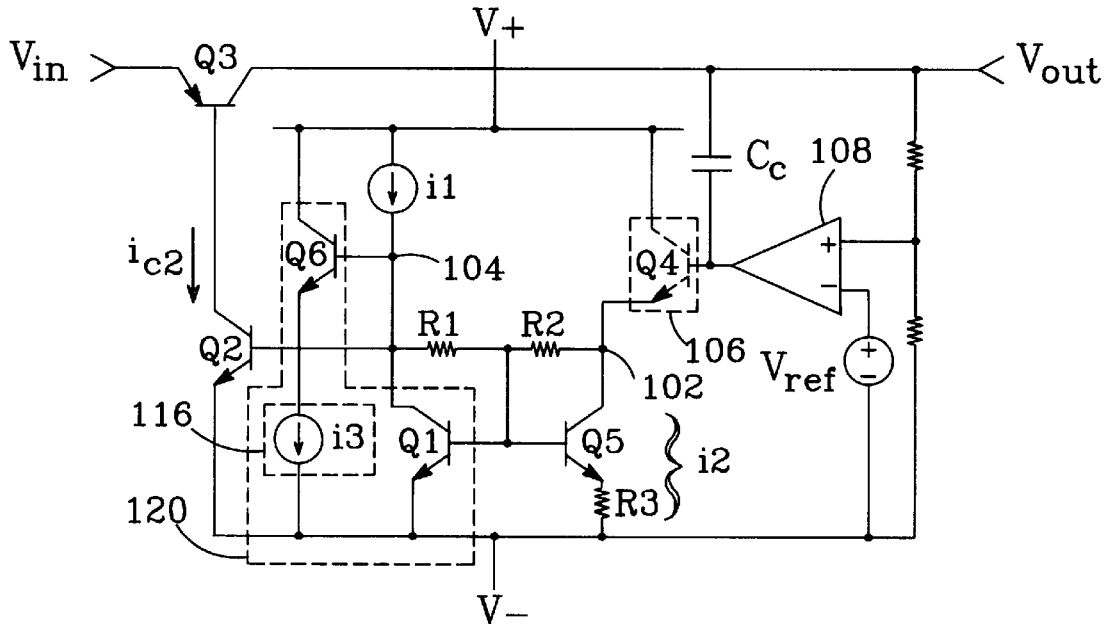
FIG. 3*a* is a schematic diagram of a preferred embodiment of the present invention.

A more detailed schematic diagram of the present invention as used in a voltage regulator is shown in FIG. 3*a*. One convenient means of implementing current source i2 employs a transistor Q5, shown here as an npn bipolar transistor, having its base connected to the base of Q1 and its collector connected to inverter input node 102, with a resistor R3 connected between Q5's emitter and V−. Together, Q1, Q5 and R3 operate like a Widlar mirror to produce a well-defined current i2 from the collector of Q5. In this arrangement, i2 is a function of i1, so that $i_{c2}$(max.) is a function of i1 and R3. Note that while convenient to connect the base of Q5 to the base of Q1, the base of Q5 can be driven with other voltages unrelated to the inverter circuit. This will be discussed in more detail below.

Base currents were neglected in Equation 2 above. However, if the ratio of $i_{c2}$(max.) to i1 is large, as it usually will be, the loading due to the base current of Q2 may not be negligible. In order to accommodate a high $i_{c2}$(max.) to i1 ratio, a buffer transistor Q6, shown here as an npn bipolar transistor, is included in the circuit of FIG. 3*a*. The base of Q6 is connected to the inverter amplifier's output node 104 and its emitter connected to the base of output drive transistor Q2. In this emitter follower configuration, Q1's collector, i.e., high impedance node 104, is no longer required to supply base current to Q2. Q6 buffers node 104, serving to drive Q2, and to supply i2 by way of R1 and R2.

Figure 3B:
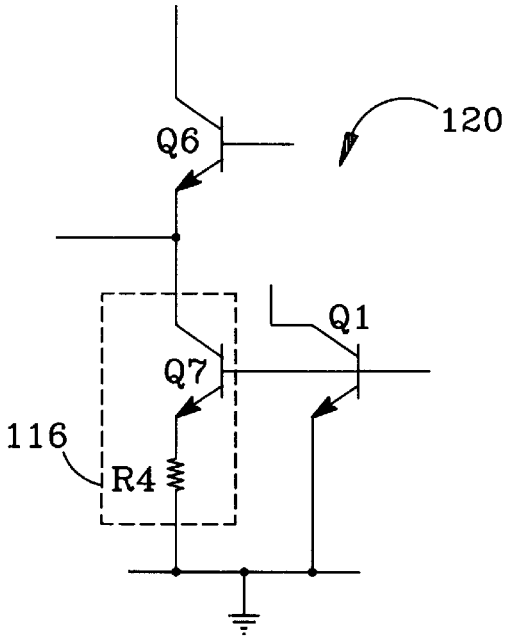
FIGS. 3*b* and 3*c* are schematic diagrams of alternate implementations of a pull-down current source in the circuit of FIG. 3*a*.

A source of current 116 must be connected to the emitter of Q6 to allow it to swing negative. One convenient way of providing the necessary pull-down current is with a current source i3. This configuration is shown in the schematic diagram of FIG. 3*b*, in which a portion 120 of the schematic of FIG. 3*a* is redrawn. A transistor Q7, shown here as an npn bipolar transistor, has its base connected in common with the base of Q1, its collector connected to the emitter of Q6, and a resistor R4 connected between Q6's emitter and V−. Note that while convenient to connect the base of Q6 to the base of Q1, the base of Q6 can be driven with other voltages unrelated to the inverter circuit.

Figure 3C:
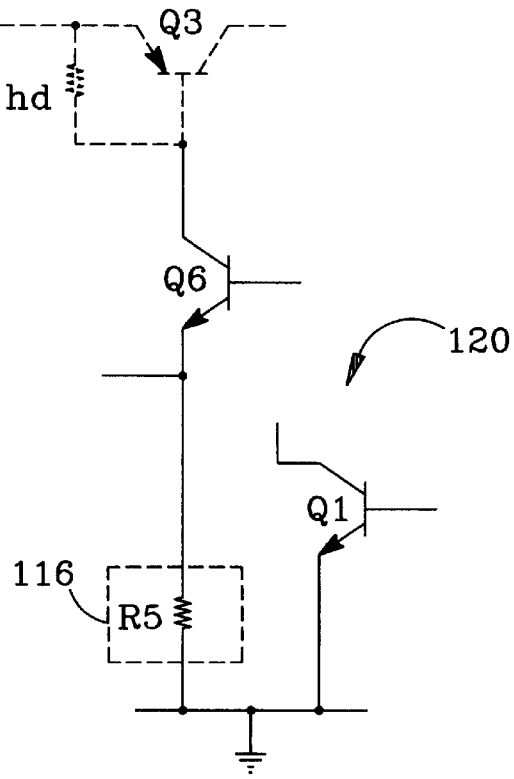

Another possible way to implement the source of current 116 is shown in the schematic diagram of FIG. 3*c*, in which a portion 120 of the schematic of FIG. 3*a* is redrawn. Here, a resistor R5 is connected between the emitter of Q6 and V− to supply pull-down current to Q6.

The use of pull-down resistor R5 may also improve the stability of the regulator at light loads. The base-emitter voltage of output drive transistor Q2 is across R5, so that the current through Q6 is at least partially complementary-to-absolute-temperature (CTAT). If Q6's collector current is drawn through a base hold-down resistor $R_{hd}$ connected across the base and emitter of pass transistor Q3, the collector current will approximately track demand by $R_{hd}$ over temperature. This enables the use of smaller $R_{hd}$ values, which is desirable because large $R_{hd}$ values can lead to non-linear relaxation oscillation at light loads.

Figure 4:
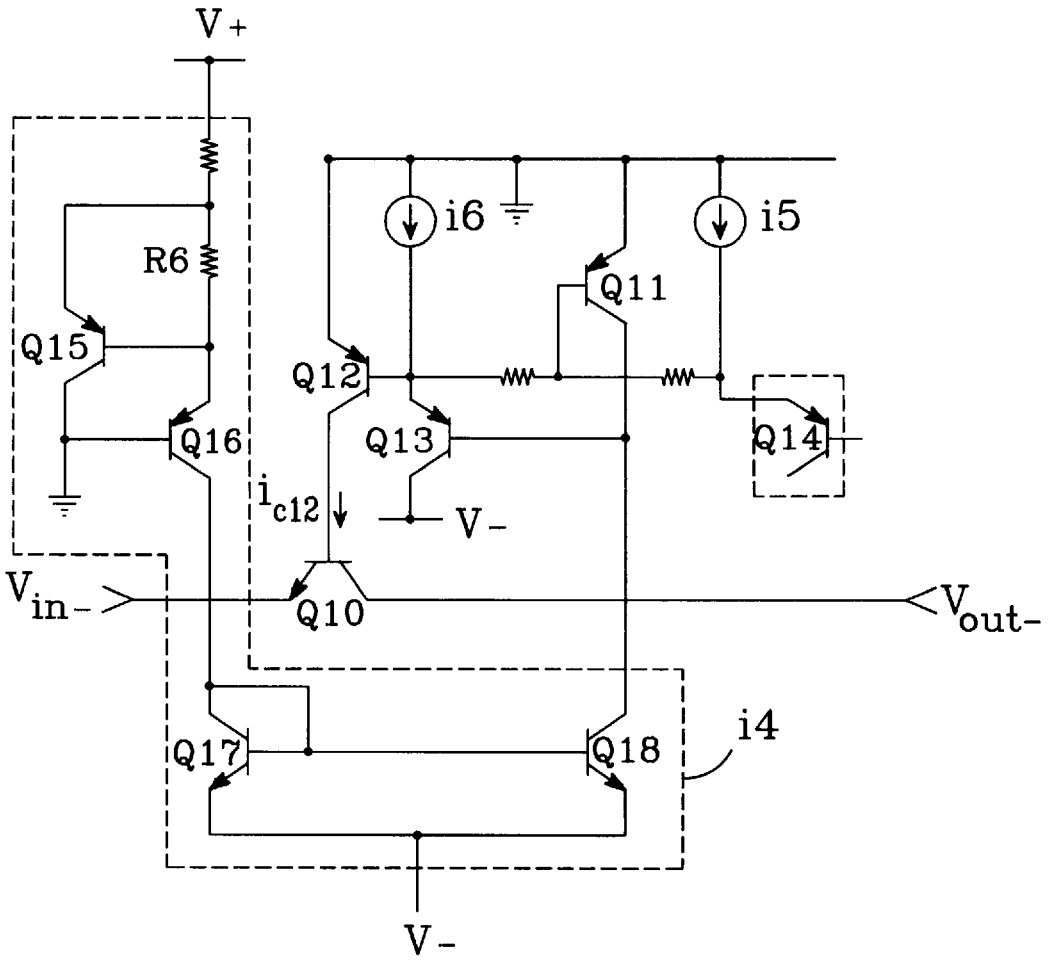
FIG. 4 is a schematic diagram of an embodiment of the present invention using pnp transistors and using a current source with a negative temperature coefficient.

The novel inverter circuit can also be implemented with pnp transistors as shown in FIG. 4, and used, for example, in a voltage regulator circuit which receives a negative supply voltage $V_{in-}$ and generates a negative output voltage $V_{out-}$. Here, pass transistor Q10 is an npn, and inverter transistor Q11, output drive transistor Q12, and buffer transistor Q13 are all pnps. The input to the inverter is typically a pnp follower transistor Q14. The inverter amplifier is biased by a current source i4, the follower transistor by a current source i5, and the buffer transistor by a current source i6.

The beta of pass transistor Q10 increases with temperature. This can be approximately compensated for by making current source i4 have a negative temperature coefficient (TC). One implementation of current source i4 which produces a bias current with a negative TC is shown in FIG. 4. A pnp transistor Q15 has a resistor R6 connected between its emitter and its base, which is connected to the emitter of a pnp transistor Q16. Q16's emitter-base junction is forward-biased, and the resulting current through Q16 pulls Q15's base low and makes Q15 active. Q15's $V_{be}$ appears across R6, making the current through R6 CTAT. This CTAT current flows through Q16 and is reflected with a current mirror formed from a diode-connected transistor Q17 and a transistor Q18 whose base is connected to Q17's base. A bias current with a negative TC thus appears at Q18's collector, i.e., i4's output, which approximately compensates for the variation in Q10's beta over temperature.

As noted in Equation 2 above, for the circuits in FIGS. 2*a* and 3*a*, the drive current $i_{c2}$ is given by:

$$i_{c2}=N(i1)e^{(i2\times R1/(kT/q)}$$

Because temperature (T) appears in the equation, the ratio of $i_{c2}$ to i1 varies with temperature. However, if current source i2 is implemented to generate a current that is largely proportional-to-absolute-temperature (PTAT), T can be virtually eliminated from the equation, making the ratio of $i_{c2}$ to i1 virtually temperature-invariant.

In the embodiments discussed to this point, current source i2 has been derived from current source i1. It is not essential, however, that i2 be derived from i1; i2 can, if fact, be completely independent of i1. In the schematic diagram of FIG. 5, a current source $i_{PTAT}$ is connected to node 102 which generates a PTAT or nearly PTAT current. Current $i_{PTAT}$ through an approximately constant value of R1 results in a PTAT ΔV (=$i_{PTAT}$×R1), and therefore an approximately constant ratio of $i_{c2}$ to i1 over temperature. Current sources which produce a PTAT output are well-known, and are discussed, for example, in P. Gray and R. Meyer, *Analysis and Design of Analog Integrated Circuits*, ($2^{nd}$ Ed.) John Wiley & Sons (1984), pp. 282–283.

Figure 5:
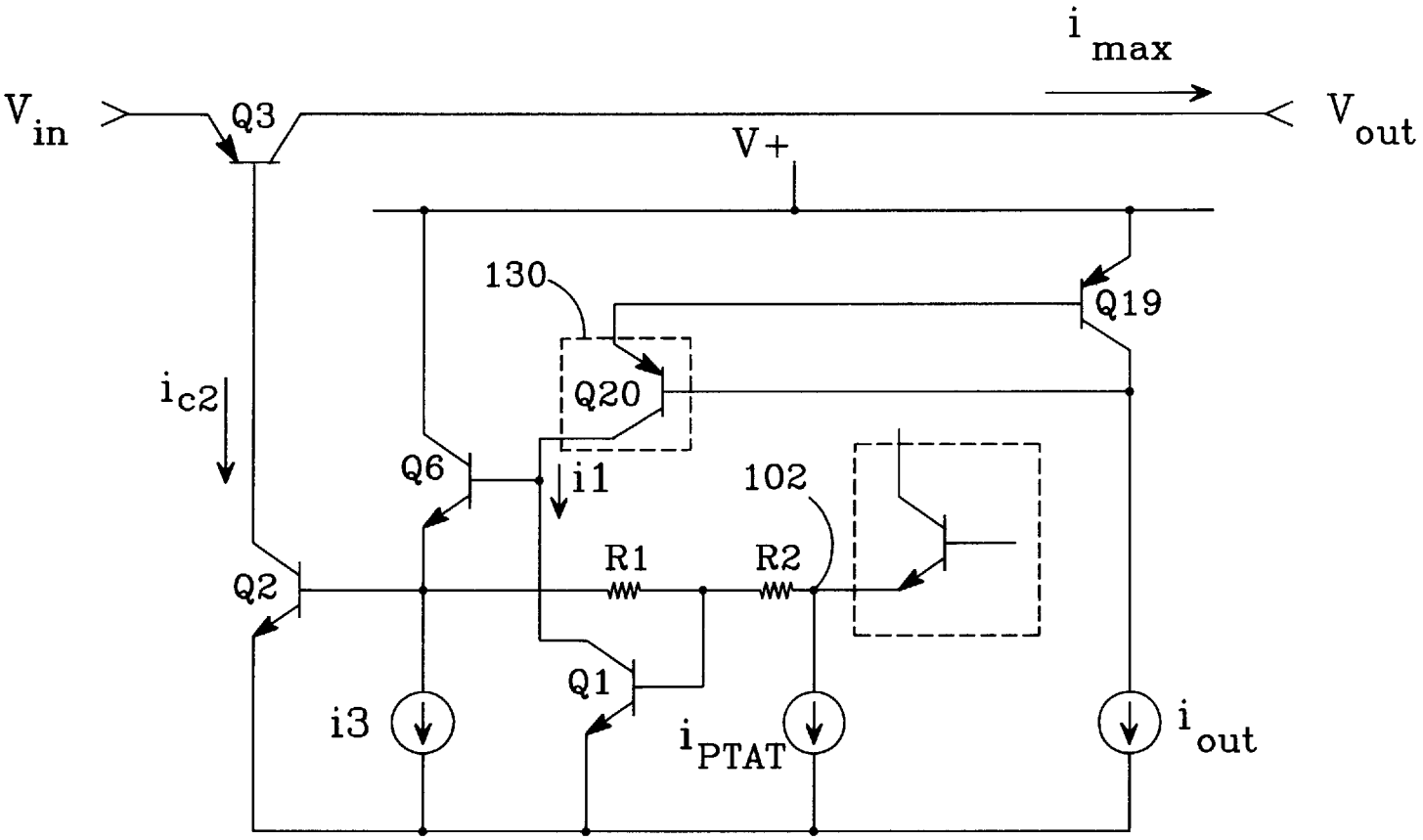
FIG. 5 is a schematic diagram of an embodiment of the present invention illustrating a technique for accommodating manufacturing variations in the beta of a series regulator's pass transistor.

A further improvement in the inverter circuit is also illustrated in FIG. 5. In general, $i_{c2}$(max.) is tailored to fit an estimate of the base current required to produce a minimum output from the pass transistor Q3. One factor included in this estimate is the temperature sensitivity of the pass transistor's beta, with $i_{c2}$(max.) required to provide a current large enough to drive a pass transistor having the lowest beta anticipated in manufacture, as influenced by temperature, to produce the stated minimum output. The technique described below enables the inverter circuit to accommodate the expected manufacturing variability found in the betas of different pass transistors.

In the circuit of FIG. 5, $i_{c2}$ is made to correlate to the actual beta of a transistor Q19, which is about equal to that of pass transistor Q3. A current $i_{out}$, proportional to a desired maximum regulator output current $i_{max}$, is delivered to the collector of a pnp transistor Q19 whose emitter is connected to a positive voltage. A means 130, preferably a pnp transistor Q20 with its base connected to $i_{out}$ and its emitter connected to Q19's base, supplies current to the base of Q19.

Current $i_{out}$ causes the collector of Q19 to go negative, driving Q20 on until it supplies the base current needed by Q19 to operate at $i_{out}$. This arrangement results in Q19's base current being about equal to $i_{out}$ divided by the beta of Q19, and this beta-dependent current is produced at Q20's collector as bias current i1, which falls as Q19's beta rises. Current i1 is connected to the collector of inverter transistor Q1 and the base of buffer transistor Q6.

As seen in Equation 2 above, the current $i_{c2}$ driving Q3 is directly proportional to i1, and is independent of the betas of the inverter and output drive transistors. However, $i_{max}$, about equal to $i_{c2}(\max.)\times\beta_{Q3}$, remains dependent on Q3's beta. Q19 and pass transistor Q3 are operated at similar current densities and are manufactured on the same I.C. die, so that their respective betas are typically well correlated. This correlation reduces the dependence of $i_{max}$ on Q3's beta: if Q3's beta is near the top of its expected range, so too will be Q19's, which results in a reduction in the i1 current delivered to the output drive transistor. Conversely, a Q3/Q19 beta near the low end of their expected range increases the value of i1. Having i1 depend on the Q3/Q19 beta that happens to result when Q3 is manufactured keeps $i_{max}$ within a tightly constrained range.

Bias current i1 is delivered to inverter transistor Q1 and is mirrored to output drive transistor Q2. This mirroring includes the factor N equal to the ratio of Q2's emitter area to Q1's emitter area, and a factor set by the ΔV (=$i_{PTAT}$×R1). Both of these factors must be taken into account to properly size $i_{out}$. For example, assume iout is set to 1 ma, $i_{max}$ is 100 ma, N is 5, and $i_{c2}$ increases by a factor of 20 due to $i_{PTAT}$ flowing through R1 at $i_{c2}$(max.) (which occurs when $i_{PTAT}$×R1=(kT/q)ln20=78 mv at T~300° K.). The drive current limit $i_{c2}$(max.) is given by:

$$i_{c2}(\max.)=1\text{ ma}/\beta_{Q19}\times5\times20=100\text{ ma}/\beta_{Q19}$$

Delivering this current to the base of Q3 results in an $i_{max}$ of 100 ma when $i_{c2}$(max.) flows through Q2.

Though FIG. 5 is shown using npn transistors for Q1, Q2, and Q6, and pnp transistors for Q3, Q19, and Q20, an equivalent circuit that generates a negative $V_{out}$ is made by reversing the polarities of the transistors, as well as the directions of the respective current source outputs.

Use of a beta-dependent i1 enables $i_{max}$ to be kept within a tightly constrained range at a particular temperature. This arrangement is preferably combined with the use of current source $i_{PTAT}$ (discussed above in connection with FIG. 5) and its resulting temperature invariant $i_{c2}$(max.) to i1 ratio, to provide an $i_{max}$ that is kept within a tightly constrained range over a broad temperature range.

While particular embodiments of the invention have been shown and described, numerous variations and alternate embodiments will occur to those skilled in the art. Accordingly, it is intended that the invention be limited only in terms of the appended claims.

I claim:

1. An inverter circuit biased to establish a maximum drive current connected to control a following stage, comprising:

an inverter transistor having a control input and first and second current terminals, a first resistance R1 connected to feed back the voltage at said first current terminal to said control input, a first current source i1 connected to said first current terminal and biasing said inverter transistor to invert an input signal suitably produced by a follower device and presented at said control input, said inverted signal appearing at said first current terminal, an output drive transistor having a control input and a current circuit, said output drive transistor connected to receive said inverted signal at its control input and producing a drive current $i_{c2}$ in said current circuit in response to said inverted signal, and a second current source i2 connected to enable the voltage at said inverter transistor's control input to be pulled lower than the voltage at said first current terminal and thereby increasing the voltage attainable at said first current terminal, the values of i1, i2, and R1 establishing a maximum drive current $i_{c2}$(max.) which can flow in said output drive transistor's current circuit independent of the respective gain characteristics of said inverter and output drive transistors.

2. The inverter circuit of claim 1, wherein i2 increases the voltage at said first current terminal by a voltage given by i2×R1 when $i_{c2}$(max.) flows through said output drive transistor.

3. The inverter circuit of claim 2, wherein said drive current is given by $i_{c2}=(i1)\ e^{(i2\times R1)/(kT/q)}$.

4. The inverter of claim 2, wherein said second current source i2 comprises a plurality of individual current sources and resistance R1 comprises a plurality of individual resistors, said individual current sources and said individual resistors combined to produce an i2×R1 value needed to achieve a desired $i_{c2}$(max.).

5. The inverter circuit of claim 1, wherein said inverter transistor and said output drive transistor are bipolar transistors, the emitter area of said output drive transistor being greater than the emitter area of said inverter transistor to increase the amount of drive current in said output drive transistor's current circuit for given values of i1, i2 and R1.

6. The inverter circuit of claim 5, wherein i2 increases the voltage at said first current terminal by a voltage given by i2×R1 when $i_{c2}$(max.) flows through said output drive transistor, and said drive current is given by $i_{c2}=N(i1)\ e^{(i2\times R1)/(kT/q)}$, with N equal to the ratio of said output drive transistor's emitter area to said inverter transistor's emitter area.

7. The inverter circuit of claim 1, further comprising a second resistance R2 connected between said inverter transistor's control input and the source of said input signal, said inverter transistor forming an inverting amplifier with said resistances, said amplifier having a gain which is approximately given by −R2/R1.

8. The inverter circuit of claim 7, wherein R1 and R2 are about equal and said inverting amplifier provides about unity gain.

9. The inverter circuit of claim 7, wherein said second current source i2 is connected to the junction between said input signal source and R2 such that said junction can swing as low as i2×R2 volts below the control input of said inverter transistor when said maximum drive current flows through said output drive transistor.

10. The inverter circuit of claim 7, wherein said second current source i2 is connected to the junction between said first resistance R1 and said second resistance R2 such that the voltage of said junction can swing as low as the control input of said inverter transistor when said maximum drive current flows through said output drive transistor.

11. The inverter circuit of claim 1, further comprising a buffer transistor having a control input connected to said first current terminal, said buffer transistor having an output arranged to drive said output drive transistor in response to the voltage at said first current terminal and to supply i2 through R1 when $i_{c2}$(max.) flows through said output drive transistor, said buffer transistor reducing the loading of said first current terminal by said output drive transistor.

12. The inverter circuit of claim 11, further comprising a source of current connected to the output of said buffer transistor to increase the range over which said output can vary.

13. The inverter circuit of claim 12, wherein said source of current is a resistor connected to provide a pull-down current to said buffer transistor.

14. The inverter circuit of claim 12, wherein said source of current comprises a transistor having a control input which is connected to said inverter transistor's control input and a current circuit which is connected to said buffer transistor.

15. The inverter of claim 1, wherein said second current source i2 comprises a transistor having a control input which is connected to said inverter transistor's control input, said transistor arranged to mirror the current through said inverter transistor.

16. The inverter of claim 1, wherein said first current source i1 is arranged to produce a current with a negative temperature coefficient to approximately compensate for an increase in beta with temperature of a transistor connected to receive said output drive current $i_{c2}$.

17. The inverter of claim 1, wherein said current source i2 produces a current that is proportional-to-absolute temperature (PTAT) such that the ratio of $i_{c2}$(max.) to i1 is temperature invariant.

18. A series pass voltage regulator which includes circuitry that limits the drive current delivered to the regulator's pass transistor, said regulator comprising:

a pass transistor having a current circuit with first and second terminals and a control input, said first current circuit terminal connected to a supply voltage and said second current circuit terminal producing a regulated output voltage in response to a drive current $i_{c2}$ presented at said control input, an error amplifier connected to receive a voltage proportional to said regulated output voltage at a first terminal and a reference voltage at a second terminal, and producing an error voltage at an output, a follower device connected to said amplifier's output, an inverter circuit arranged to establish a maximum drive current through an output drive transistor connected to control said pass transistor, said inverter circuit comprising:

an inverter transistor Q1 having a control input and first and second current terminals, a first resistance R1 connected to feed back the voltage at Q1's first current terminal to Q1's control input, a first current source i1 connected to Q1's first current terminal and biasing Q1 to invert an input signal produced by said follower device and presented at Q1's control input, said inverted input signal appearing at Q1's first current terminal, an output drive transistor having a control input and a current circuit, said output drive transistor connected to receive said inverted input signal at its control input and producing said drive current $i_{c2}$ in its current circuit in response to said inverted input signal, and a second current source i2 connected to bias said follower device and enabling the voltage at Q1's control input to be pulled lower than the voltage at Q1's first current terminal in response to said input signal and thereby increasing the voltage attainable at Q1's first current terminal, the values of i1, i2, and R1 establishing a maximum drive current $i_{c2}$(max.) which can flow in said output drive transistor's current circuit independent of the respective gain characteristics of said inverter and output drive transistors, thereby limiting the drive current delivered to said pass transistor.

19. The voltage regulator of claim 18, wherein i2 increases the voltage at Q1's first current terminal by a voltage given by i2×R1 when $i_{c2}$(max.) flows through said output drive transistor.

20. The voltage regulator of claim 18, further comprising a capacitor connected between said pass transistor's second current terminal and said error amplifier output to frequency compensate said regulator.

21. A series pass voltage regulator which includes circuitry that accommodates anticipated manufacturing variations in pass transistor beta values, said regulator comprising:

a bipolar pass transistor arranged to produce an output voltage at a desired maximum regulator output current, said pass transistor having a particular beta characteristic, an error amplifier connected to receive a voltage proportional to said output voltage at a first terminal and a reference voltage at a second terminal, and producing an error voltage at an output, a follower device connected to said amplifier's output, an inverter circuit arranged to establish a maximum drive current through an output drive transistor connected to control said pass transistor, said inverter circuit comprising:

an inverter transistor Q1 having a control input and first and second current terminals, a first resistance R1 connected to feed back the voltage at Q1's first current terminal to Q1's control input, a first current source i1 connected to Q1's first current terminal and biasing Q1 to invert an input signal produced by said follower device and presented at Q1's control input, said inverted input signal appearing at Q1's first current terminal, i1 comprising:

a first bipolar transistor having a beta characteristic which is about equal to that of said pass transistor and biased with a current $i_{out}$ that is proportional to said desired maximum regulator output current, means connected to supply the current to said first transistor's base needed to operate said first transistor at $i_{out}$, said current supplied to said first transistor's base thereby dependent on the beta of said first transistor, said beta-dependent current conveyed by said means to Q1's first current terminal as the output of current source i1, an output drive transistor having a control input and a current circuit, connected to receive said inverted input signal at its control input and producing said drive current $i_{c2}$ in its current circuit in response to said inverted input signal, a second current source i2 connected to bias said follower device and enabling the voltage at Q1's control input to be pulled lower than the voltage at Q1's first current terminal in response to said input signal and thereby increasing the voltage attainable at Q1's first current terminal, the values of i1, i2, and R1 establishing the maximum drive current $i_{c2}$(max.) which can flow in said output drive transistor's current circuit independent of the respective gain characteristics of said inverter and output drive transistors, thereby limiting the drive current delivered to said pass transistor, and current source i1's beta-dependent output reducing variations in maximum regulator output current due to manufacturing variations in the beta of said pass transistor.

22. The voltage regulator of claim 21, wherein current source i2 produces a current that is proportional-to-absolute temperature (PTAT) such that the ratio of $i_{c2}$(max.) to i1 is temperature invariant.

23. A method of limiting the drive current which is produced by an inverter circuit and which drives a following stage, comprising the steps of:

connecting a resistance R between a first current circuit terminal and a control input of a first transistor, biasing said first transistor with a current i1 to invert an input signal received at its control input and to produce said inverted signal at said first current circuit terminal as an output, modulating a second transistor with the output from said first current terminal to produce a drive current suitable for controlling a following stage, and supplying a current i2 through said resistance R when said input signal is at a negative limit, said current increasing the voltage of said modulating signal to said second transistor by an amount equal to i2×R and thereby establishing a maximum drive current based on the values of i1, i2 and R.

24. The method of claim 23, wherein said drive current drives a pass transistor of a series pass voltage regulator.

25. The method of claim 24, wherein said current i1 has a negative temperature coefficient (TC), said negative TC reducing said maximum drive current with increasing temperature and approximately compensating for the increase in beta with temperature of said regulator's pass transistor.

26. The method of claim 24, wherein said pass transistor is a bipolar transistor having a particular beta, said current i1 generated by performing the steps of:

placing a bias current in the current circuit of a third bipolar transistor, said third bipolar transistor having a beta about equal to that of said pass transistor, connecting a fourth transistor to supply the current to said third bipolar transistor's base needed to operate said third bipolar transistor at said bias current, and conveying said current supplied to the base of said third bipolar transistor to said first transistor as current i1, said current i1 inversely proportional to the beta of said third bipolar transistor, said beta-dependent current reducing variations in maximum regulator output current due to manufacturing variations in the beta of said pass transistor.

27. The method of claim 26, wherein said current i2 is a proportional-to-absolute-temperature (PTAT) current, said PTAT current making the ratio of said drive current to said current i1 temperature invariant.

* * * * *

UNITED STATES PATENT AND TRADEMARK OFFICE

CERTIFICATE OF CORRECTION

PATENT NO. : 5,886,570

DATED : March 23, 1999

INVENTOR(S) : A. Paul Brokaw

It is certified that error appears in the above-identified patent and that said Letters Patent is hereby corrected as shown below:

In the drawings, Sheet 2, FIG. 3a, should appear as follows:

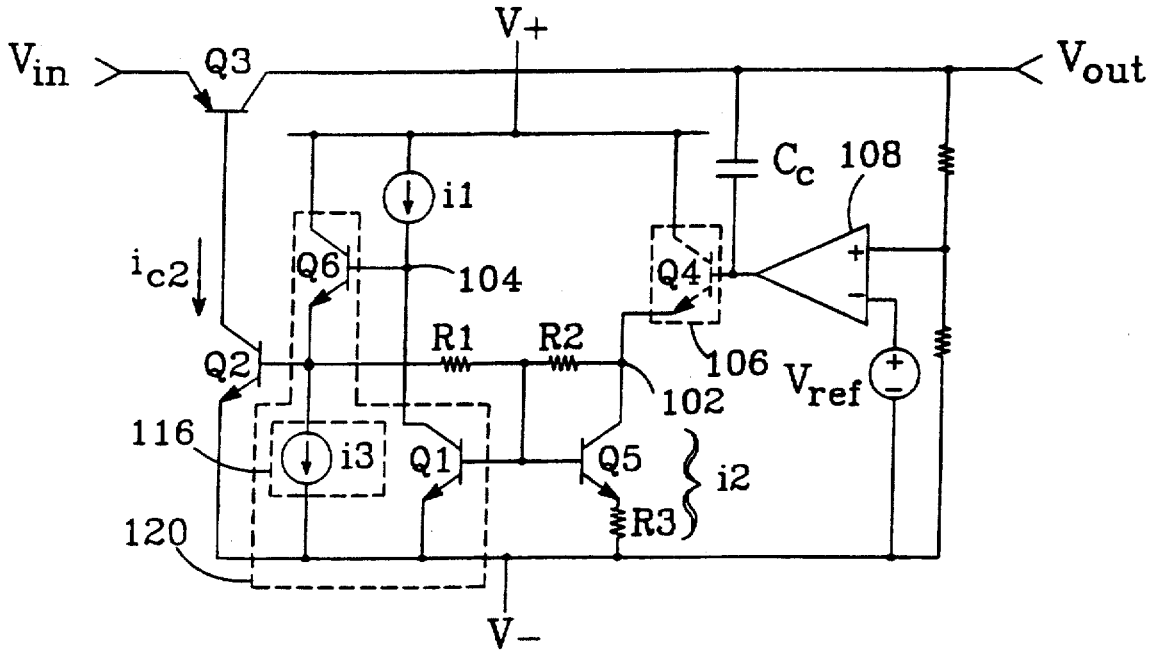

Signed and Sealed this

Fourteenth Day of September, 1999

*Attest:*

Q. TODD DICKINSON

*Attesting Officer*

*Acting Commissioner of Patents and Trademarks*

UNITED STATES PATENT AND TRADEMARK OFFICE

CERTIFICATE OF CORRECTION

PATENT NO. : 5,886,570

DATED : March 23, 1999

INVENTOR(S) : A. Paul Brokaw

It is certified that error appears in the above-identified patent and that said Letters Patent is hereby corrected as shown below:

On the title page, item [73] should be added;

Assignee: Analog Devices, Inc., Norwood, Massachusetts

Signed and Sealed this

Sixteenth Day of November, 1999

*Attest:*

Q. TODD DICKINSON

*Attesting Officer*

*Acting Commissioner of Patents and Trademarks*